United States Patent [19]

Miller

[11] 4,036,047

[45] July 19, 1977

[54] BODYMAKER PUNCH AND RAM

[75] Inventor: Edward C. Miller, Broomfield, Colo.

[73] Assignee: Ball Corporation, Muncie, Ind.

[21] Appl. No.: 626,676

[22] Filed: Oct. 28, 1975

[51] Int. Cl.[2] ..... B21D 22/21

[52] U.S. Cl. ..... 72/347; 113/7 A; 113/120 H

[58] Field of Search ..... 72/344, 345, 347–349, 72/479, 480; 113/7 A, 120 H

[56] References Cited

U.S. PATENT DOCUMENTS

| | | | |
|---|---|---|---|
| 3,524,338 | 8/1970 | Bozek | 72/345 |
| 3,911,719 | 10/1975 | Degenhardt et al. | 72/349 X |

*Primary Examiner*—Robert Louis Spruill

*Attorney, Agent, or Firm*—James D. Haynes

[57] ABSTRACT

A punch for mating engagement with a ram for use in forming D&I can bodies. The punch has a plurality of lands disposed about the internal periphery thereof which results in the punch having significantly more mass at or near the nose thereof than it does at the opposing end. A plurality of lands disposed on the ram mate with respective lands within the punch to support and maintain the punch in a workable posture. The improved punch and ram assembly result in increased strength in the punch near the nose and increased strength in the ram at the area most removed from the nose of the punch and yet in engagement with the punch.

6 Claims, 7 Drawing Figures

BODYMAKER PUNCH AND RAM

BACKGROUND OF THE INVENTION

This invention relates to an improved bodymaker punch and ram and more particularly to the particular structural limitations of the ram and punch which provide increased durability and thus enhanced life.

In the art of making two-piece cans, a typical method of manufacture consists of making a circular blank and then drawing the blank to form a shallow cup. The shallow cup is then redrawn to reduce its diameter and deepen the cup. The resulting cup is then wall-ironed to reduce the wall thickness and further deepen the cup to ultimately provide the body for a two-piece can. To produce the body of a two-piece can the cup is entered by a punch element and is forced thereby through a wall-ironing tool pack which may consist of one or more ironing rings. In this operation the wall thickness is reduced to the required final dimension, and the wall length is increased to somewhat more than the required final length. A bottom forming or doming operation is then performed on the integral end and finally the free end of the formed can body is trimmed to the required length.

The presses for directing the movement of the punch may be either mechanical or hydraulic. Exemplary of such machines are U.S. Pat. Nos. 3,702,559 to Hassellbeck et al. entitled "Can Bodymaking Machine" and 3,855,862 to Moller entitled "Draw and Wall Iron Process for Metal Cans".

Punches for use in manufacturing steel cans are made of tungsten carbide since tungsten carbide has been found to be inert and resist adherence to the steel. This increases the ease with which a can body may be stripped from the bodymaker punch. While the use of a tungsten carbide punch increases the ease of stripping the can body from the punch, other desirable characteristics are decreased. The punch is inherently weaker when compared with a steel punch because of the inherent characteristics of the tungsten carbide which is very brittle and very expensive.

A punch is traditionally joined to a ram for reciprocal movement relative to a die box wherein a preformed cup is modified into a can body. The rapid movement of the punch and the extreme stresses exerted thereon during its cycle result in a short punch life. The nose area of the punch is particularly vulnerable to stresses and is the primary area of punch failure. As the ram reciprocates in and out of the die box, it is also subject to varying stresses which sometime results in the ram being kinked or slightly bent at the point where the rearmost area of the punch engages the ram.

The punch is joined to the ram by a punch mounting nut which is threadably located within the ram. This results in asymetrical loading of the punch. The flange of the nut does not evenly engage the flange and thus results in varying pressure being exerted on the punch about its periphery. Consequently, there is an increased likelihood that the punch will fracture. This problem is more critical when a tungsten carbide punch is being used than when a steel punch is being used.

SUMMARY OF THE INVENTION

It is an object of the present invention to provide a punch and ram assembly which greatly increases the expected life of the punch by increasing the cross-sectional area of the punch near the nose of the punch.

It is another object of this invention to provide a bodymaker ram with increased strength at an area most removed from the nose of the punch and yet in engagement with the punch, to reduce the probability that the ram will kink or bend during operation.

It is yet another object of this invention to provide a punch mounting nut which more accurately secures the punch to the ram to thus prevent asymetrical loading of the punch which has resulted in breakage of the punch and bending or kinking of the ram.

The internal dimensions of the punch and the external dimensions of the ram complement each other and permit the ram and the punch to be engaged in a mating relationship. The ram has a plurality of lands on the external periphery thereof which are spaced along its axial length while the punch has a plurality of lands disposed internal thereto and at such locations along its axial length as to engage the respective lands of the ram. The improved punch and ram comprising the present invention results in an increased cross-sectional area in the punch at an area near the nose of the punch and an increased cross-sectional area in the ram at the area most removed from the nose of the punch and yet in engagement with the punch. Accordingly, the wall thickness of the punch nearest the nose of the punch is greater than the thickness of the wall of the punch nearer the other end thereof. Additionally, the wall thickness of the punch at the land nearest the nose exceeds the wall thickness of the punch at the other land. The internal diameters of the lands are all different. The internal diameters of the land nearest the nose is less than the diameters of the other lands which diameters are progressively larger as their distance from the nose of the punch increases.

DESCRIPTION OF THE PREFERRED EMBODIMENT

Figure 1:
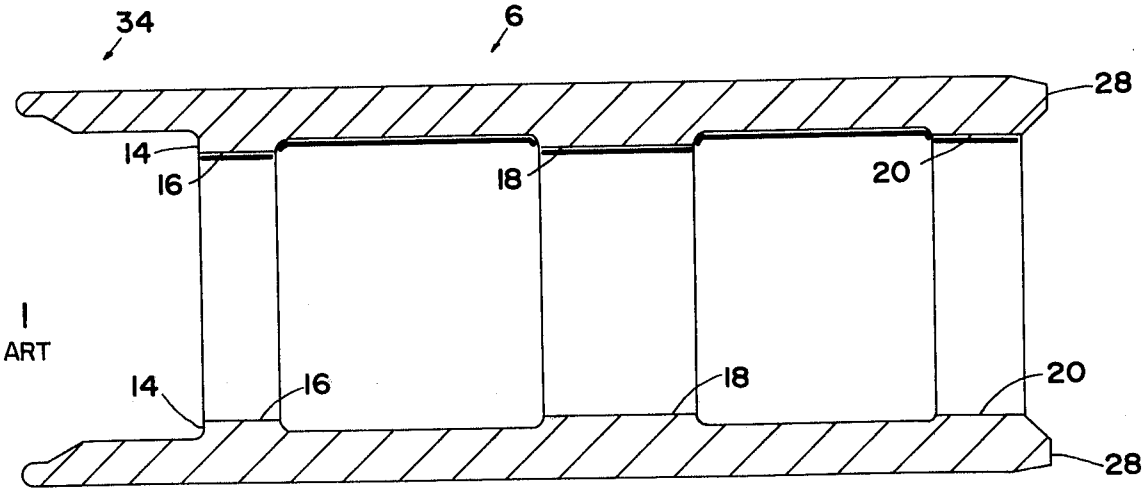
FIG. 1 PRIOR ART
FIG. 1 is a cross-sectional view of a prior art punch.
Figure 2:
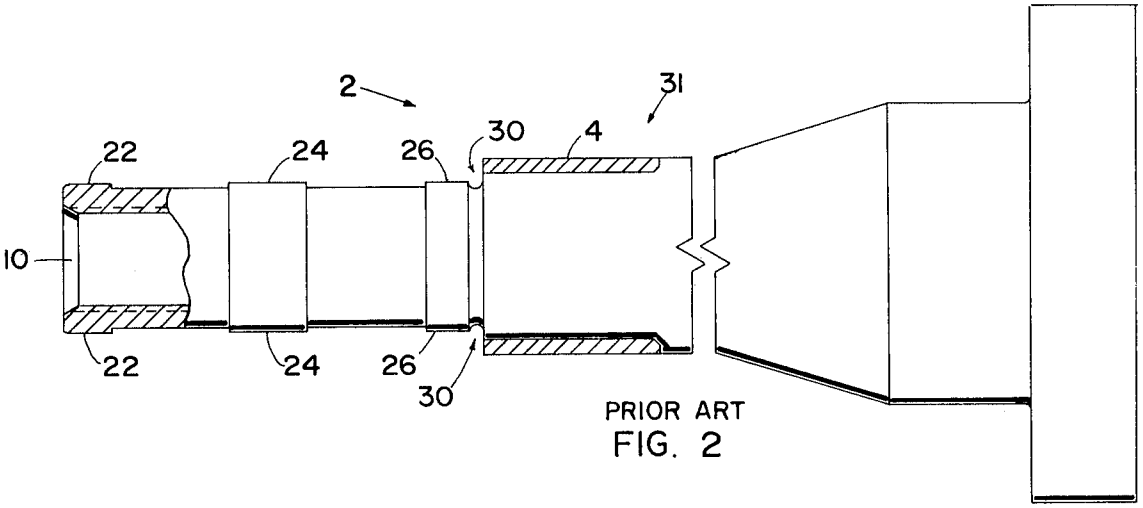
PRIOR ART FIG. 2
FIG. 2 is a side view of a prior art ram partly in cross-section.

Referring to the drawings wherein like numerals are used to designate like components throughout, FIG. 1 discloses one of many prior art bodymaker punches. FIG. 2 discloses a prior art ram for use with the punch disclosed in FIG. 1. The ram 2 receives the punch 6 in a mating relatonship. A punch mounting nut 8 (FIG. 7) mates with the ram in the area generally denoted as 10. When the punch mounting nut 8 is engaged with ram 6 its surface 12 engages surfaces 14 on the punch to fixedly engage the punch to the ram. Lands 16, 18, and 20 are internal to the punch and engage lands 22, 24, and 26 of the ram. When the punch is engaged to the ram, butt portions 28 of the punch reside against bushing 4 and the ram at 30.

In operation, the ram drives the punch toward a die box wherein a cup is drawn and ironed to form the body of a two-piece can. The punch is secured to the ram by punch mounting nut 8 disclosed in FIG. 7. The threads 32 on punch mounting nut 8 engage in the threaded portion 10 at the leading end of ram 2.

It has been well known that threads are not an ideal surface locating means. Accordingly, the flanged area 12 on the punch mounting nut 8 may exert spot loading or asymetrical loading on surfaces 14 of the land 16 which will result in increasing the likelihood of punch failure. This asymetrical loading may result in the nose area 34 of the punch being broken. Additionally, punch failure has been known to cause the ram to bend or kink generally in the areas denoted by reference numerals 30 and 31. Either of the aforementioned occurrences subjects the can manufacturing line to significant downtime and results in significant costs in replacement of the damaged parts. A tungsten carbide punch will cost at present something in excess of $800 each. A typical ram will cost approximately $1,000.

The punch may also fracture due to its own design. As shown in FIG. 1, the nose area 34 has a significant cantilevered portion from land 16 to the outer most point of the nose which first engages the metal to be conformed into the body of a can.

After the body of the can has been formed about the periphery of the punch, it is necessary to remove the can body from the punch. Traditionally this is done by a can stripper (not shown). The stripper is normally disposed on the side of the can making dies (not shown) opposite the bodymaker punch and ram. As the ram strokes forward through the can making dies it emerges therefrom and through the stripper to cause the stripper to engage the open end of the can body and strip it from the punch during the return stroke. The stripper engages bushing 4 and slips therealong to ultimately come in contact with the open end of the body to strip the body from the bodymaker punch. The presence of this pressed bushing directly behind the punch causes a stress concentration at this point. This stress concentration results in the ram being more susceptible to being bent or kinked at area 31 as previously discussed.

Figure 3:
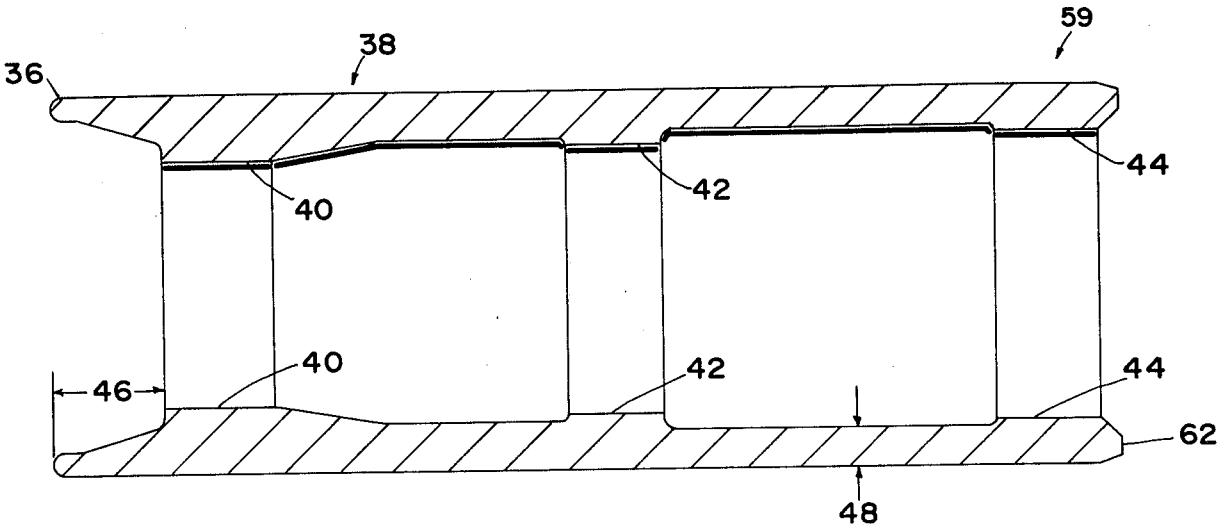
FIG. 3 is a cross-sectional view of the punch according to the instant invention.

The bodymaker punch, according to the present invention, is disclosed in FIG. 3. The ram for use with the bodymaker punch of FIG. 3 is disclosed in FIG. 4. As can be seen by comparing FIG. 3 to FIG. 1, the nose 36 of ram 38 is the same as nose 34 of the prior art punch 6. The improvement in the punch 38 resides in the precise placement of the lands 40, 42, and 44. Also, it may be seen that the exterior wall dimension of the present invention is not uniform in thickness as were the walls of prior art punch 6. The thickness of the wall of punch 38 is the same from the nose 36 through land 42. Thereafter, the thickness of the wall of the punch is substantially less. The outside diameter of the punch may be varied to accommodate the particular size of the can being manufactured, e.g., 209, 211, etc.

The first land 40 is positioned adjacent nose 36 and substantially increases the cross-section of the punch in this area. The preferred embodiment discloses that the internal diameter between the first and second lands is tapered. There is no particular significance in the length of the taper or the exact angle of the taper. The importance of land 40 is its location and its resulting increase in the cross-section of the bodymaker punch at this location. The purpose of the taper is to make a smooth transition between the two diameters so there will be no stress concentrations.

By placing the land 40 as disclosed in FIG. 3, the overhang of the cantilevered nose section has been significantly reduced with a corresponding reduction in the likelihood that the same pressures as exerted on a prior art device would cause nose 36 to break or fracture. Overhang 46 should be as short as possible. In view of the dimensional needs of the punch mounting nut and the need to permit suffficient clearance for doming the can bottom, the dimension in a preferred embodiment is 0.7 inches. The overall length of the punch in a preferred embodiment is 7 inches.

The rearmost area of the punch 58 has a wall thickness which is less than the thickness of the wall adjacent nose 36 and between the first land 40 and the second land 42. By reducing the wall thickness 48 of punch 38, the external diameter of the ram in this area may be increased to thereby increase its strength and resistance to kinking or bending.

Lands 40, 42, and 44 all have different internal diameters. The main purpose for having lands as opposed to a continued internal surface is to minimize the areas which require precision grinding. The punch is one piece of tungsten carbide which has a plurality of lands machined into its hollow interior. It will be noted that land 40 has an internal diameter which is less than land 42 and that land 42 has an internal diameter which is less than the internal diameter of land 44. This permits the ram to slip easily into the punch and to simultaneously have its corresponding lands 50, 52, and 54 (FIG. 4) mate with and provide support to lands 40, 42, and 44 of the punch. Varying the diamters of the lands also permits a significant mass to be incorporated into the punch at the area nearest its nose 36 and permits a significant mass to be incorporated into the ram 56 at the area wherein it previously was subject to being bent or kinked, this area being generally in the vicinity of land 54 as denoted in FIG. 4.

A typical length of a stroke of a bodymaker punch is 24 inches. The punch will carry the cup through the tool pack wherein it is formed into a can body and then through a stripper. Upon the return stroke of the punch, the can body is stripped from the bodymaker punch. As previously noted, in the prior art embodiment the stripper engaged bushing 4 (FIG. 2). In the present embodiment, the stripper engages the rearmost portion 59 of the punch. Accordingly, the punch has been slightly increased in length from the prior art embodiment.

The friction exerted by the stripped upon the punch in area 59 does result in some wear on the punch as the can body is stripped from the punch. It is, however, accepted practice to remove the punches from the machines every two or three days and subject them to close scrutiny. During this inspection process the exterior of the punch is reground to the desired configuration. Since it is traditional in most can making operations to have a tolerance of 1/10,000 of an inch, the punch may be successively reground to remove imperfections while remaining within the permitted tolerance. Of course, once the punch reaches the minimum dimension, it must be discarded. By lengthening the punch, the necessity for the bushing has been removed and the strength of the ram increased where needed.

Figure 4:
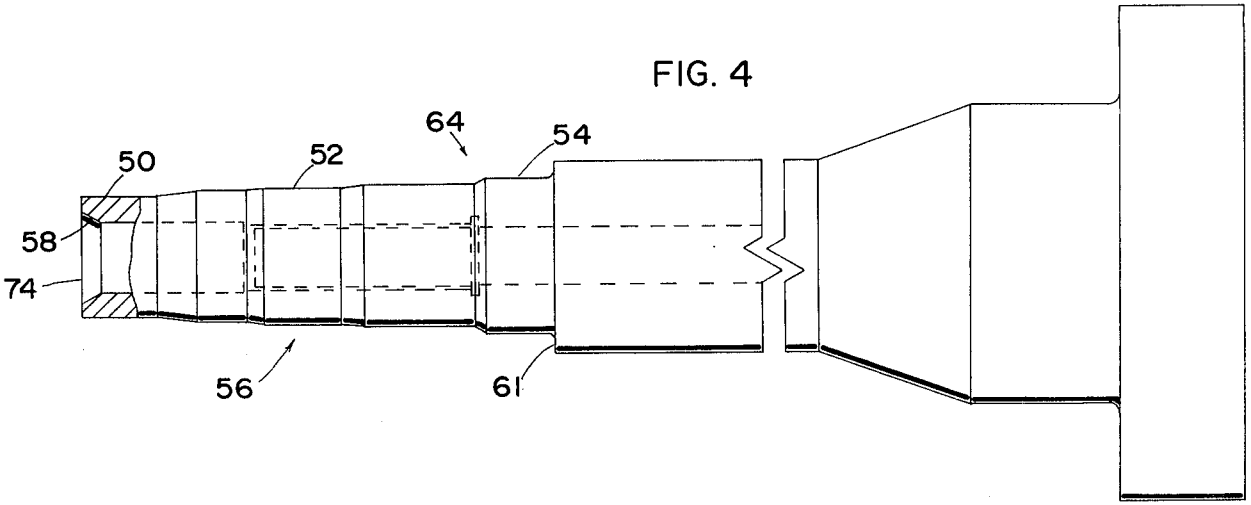
FIG. 4 is a side view of the ram, partly in cross-section, according to the present invention.

The ram, according to the present invention, is disclosed in FIG. 4. The external dimensions of the ram are complementary to the internal dimensions of the punch so that the punch may be slipped over the ram and come into a secured relationship therewith. It is to be noted that the external diameter of the ram increases from receiving end 58 to the abutting surface 61 which mates with butt surface 62 of punch 38 (FIG. 3). Lands 50, 52, and 54 are precision machined to mate with lands 40, 42, and 44, respectively, of punch 38. The improved ram, according to the present invention, results in an increased mass near the rear area of the ram generally denoted as 64. This adds strength to the ram in this critical area wherein it had previously been subject to bending or kinking.

Referring to FIG. 2, the prior art ram may be seen to have had lands 22, 24, and 26 which had substantially the same external diameters. Additionally, press fit bushing 4 was a part of the ram and operated to protect the ram from the stripper (not shown). In the present invention the bushing has been removed and the mass of the ram in this area increased. Additionally, the length of the punch has been increased so that the punch now serves the purpose previously served by bushing 4. Use of the present ram and punch assembly has resulted in substantially eliminating breakage during operation.

Figure 5:
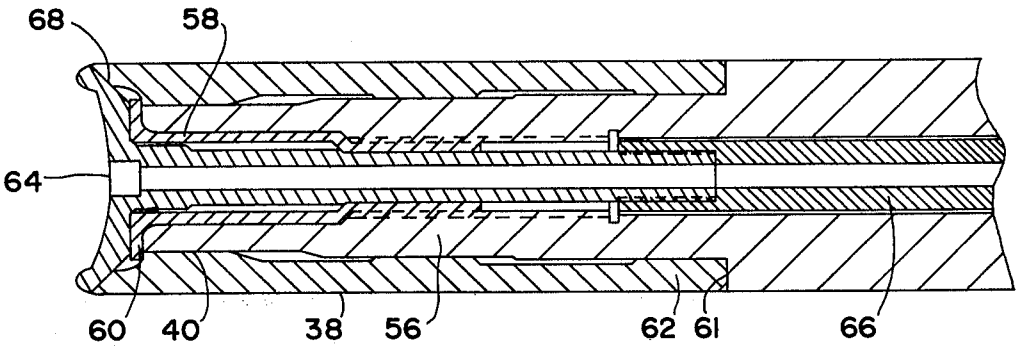
FIG. 5 is a cross-sectional side view of an alternative embodiment of a bodymaker punch and ram as assembled for operation.

In FIG. 5 punch 38 is shown mounted on ram 56. This figure is an axial cross-sectional view of the body-maker punch and ram assembly. Punch mounting nut 58 secures the punch to the ram. The punch mounting nut 58 is shown in more detail in FIG. 6. As can been seen in FIG. 5, flange 60 of punch mounting nut 58 engages the perpendicular surface of land 40 of punch 38 to secure the punch to the ram. The butt portion 62 of punch 38 seats against the rear of the ram 61. As will be explained hereinafter, the punch mounting nut 58 secures the punch in the operative position in such a manner as to effectively eliminate any chance for unequal exertion of pressure (spot loading) by flange 60 of punch 38 which had in the past resulted in slight misalignment of the mounting nut and asymetrical loading of the punch.

The punch disclosed in FIG. 5 is modified from that disclosed in FIG. 3. FIG. 5 discloses a punch as modified to incorporate into the punch and ram assembly a positive knock-out features. In certain applications it is desirable to have a positive knock-out member within the punch and ram assembly to exert some pressure against the bottom of the can prior to its removal from the punch by the stripper. As can be seen in FIG. 5 the positive knock-out 64 is axially aligned with the ram and the punch and slips through the interiors of each to threadably engage the operative support 66 therefor. As disclosed in this FIGURE, the nose of the punch has been removed and is a part of the positive knock-out 64. Its presence does not in any way modify or alter the performance of the punch and the inherent characteristics disclosed hereinabove for the particular embodiment of the present invention. The positive knock-out is machined to interface with the punch 38 at surface 68.

Figure 6:
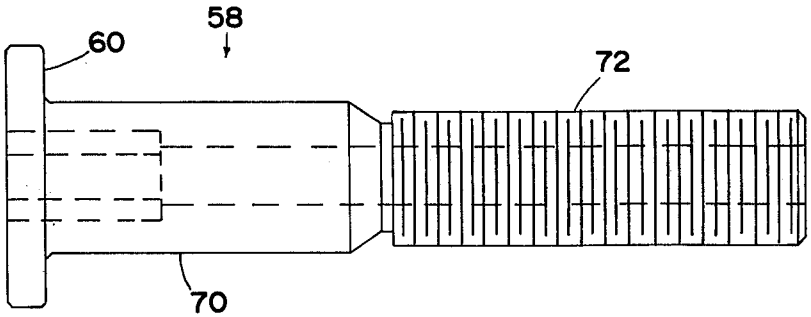
FIG. 6 is a side view of the punch mounting nut according to the present invention.
Figure 7:
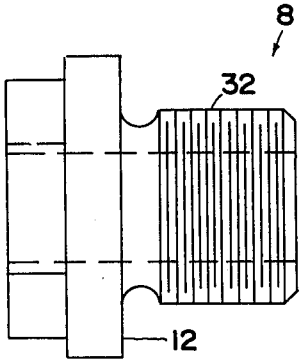
PRIOR ART FIG. 7
FIG. 7 is a side view of a prior art punch mounting nut.

Punch mounting nut 58 is disclosed in FIG. 6. A prior art punch mounting nut is disclosed in FIG. 7. As can be seen in FIG. 7 the prior art punch mounting nut had a threaded portion which mated with the ram to bring flange area 12 into mating relationship with the land of a respective punch. In the present invention, the punch mounting nut 58 has a cylindrical portion 70 positioned between the threaded portion 72 and the flange 60. The cylindrical portion 70 mates with a female area disposed within the ram and provides a significant area for interrelationship between the two parts whereby the ultimate securing relationship between flange 60 and the surface of land 40 perpendicular to the longitudinal axis of punch 38 is uniform about the periphery of flange 60. Use of the present punch mounting nut 58 has significantly reduced the probablility that a punch will be subjected to unequal distribution of forces about land 40. In operation, the punch mounting nut slips into the punch and the ram and threadably engages the ram to secure the punch to the ram. The punch mounting nut inserts into end 74 of the ram 56 (FIG. 4). As can be seen from FIG. 3, there is a limited amount of length between the outward surface of land 40 and the end of nose 36. Accordingly, the punch mounting nut 58 is provided with a recessed hexagonal area for exerting tangential forces thereinto to cause the punch mounting nut to threadably engage the ram.

A preferred embodiment of the present invention has been described herein and shown in the accompanying drawings to illustrate the underlying principles of the invention. It is to be understood that numerous modifications may be made without departing from the broad spirit and scope of the invention.

I claim:

1. A bodymaker punch and ram assembly comprising an improved punch and an improved ram, said punch being a hollow cylindrical member comprising an overhang portion having a nose for engagement with material to deform said material about the exterior of said punch and a body connected to and coextensive with said nose, said body having an internal diameter and an external diameter, said external diameter being substantially constant along its length, said overhang portion tapering from said nose portion to where said overhang portion joins said body portion, said body having an internal axial bore and a plurality of lands disposed at predetermined locations along the axial length of said bore, each said land having an internal diameter, a first said land being disposed on the interior wall of said body adjoining said nose to thereby increase the mass of material in said body portion at this location and thereby increase the physical endurance of said punch, wherein the thickness of said punch along the diameter of said punch at said first and said second lands differ, wherein the internal diameter of said second land is greater than the internal diameter of said first land, and wherein the wall of said body has at least a first and a second thickness along its axial length.

2. A punch as set forth in claim 1 wherein the overhang of said nose is 0.7 inches or less and wherein said first land has a surface normal to the longitudinal axis of said punch for engagement with a mounting means to secure said punch to a ram.

3. A bodymaker punch for use in making bodies, said punch comprising a nose for engagement with and deformation of said can material and an improved body portion for strengthening said body to prevent breakage thereof, said punch being a hollow cylindrical member having an external diameter and a first and a second internal diameter and further having at least first and second lands disposed about the interior surface thereof said first land having a first internal diameter and said second land having a second internal diameter, a first of said lands being disposed adjacent said nose to thus increase the cross-section of said body portion at this location; a second of said lands being disposed near the end of said body portion most remote from said nose and wherein the difference between said first internal diameter of said first land and the first internal diameter of said punch is greater than the difference between said second internal diameter of said second land and said second internal diameter of said punch; said first land being disposed along a portion of the interior surface of said body having said first internal diameter and said second land being disposed along a portion of the interior surface of said body having said second internal diameter, said first internal diameter being less than said second internal diameter.

4. A ram for supporting a bodymaker punch for use in making can bodies wherein said ram has an improved body portion for engagement with and support of said punch, said ram having a plurality of lands disposed along the external length thereof, a first of said lands being disposed at the rearward moving end of said ram and having an external diameter which is greater than the external diameter of said first land to thereby increase the mass of material in said ram at said rearward moving end; a second of said lands being disposed at the forward moving end of said ram, said forward moving end having means disposed therein for securing a punch to said ram, said means for securing a punch to said ram comprising a cylindrical, axial bore opening at said forward moving end of said ram for receiving a punch mounting nut, said cylindrical, axial bore having a threaded portion nearer said rearward moving end and a cylindrical portion near said forward moving end, said cylindrical portion complementing a similar portion disposed on a punch mounting nut for receiving therethrough the punch mounting nut, said cylindrical portion being of sufficient length and diameter to cause forces subjected on said punch by said punch mounting nut to be equally distributed.

5. A bodymaker punch and ram assembly comprising:

a. a punch comprising a hollow cylindrical member having a nose, a body, a rear and a plurality of lands disposed within said body, a first of said lands adjoining said nose and having a first surface perpendicular to the longitudinal axis of said punch, and wherein the interior diameter of said body at said first land is less than the interior diameter of said body at said rear of said body;

b. a cylindrical ram having a plurality of lands disposed along the length thereof, said ram having a first end for insertion into and mating with said punch, said first end having an engaging means disposed therein, said ram having a land disposed at said first end and a land disposed at the other end of said ram, the external diameter of said first land being smaller than the external diameter of the land disposed at the other end of said ram, and wherein said engaging means comprises a cylindrical, axial bore opening at said first end of said ram and a cylindrical, axial, threaded bore connecting with said cylindrical, axial bore; and c. a punch mounting nut comprising a member having a flange about a first end thereof, a threaded portion about a second end thereof and a cylindrical portion therebetween, said flange extending outwardly from said member whereby said flange engages said first surface perpendicular to the longitudinal axis of said punch when said punch mounting nut is inserted through said punch and into said ram to detachably engage said punch to said ram by the engagement of the threaded portion of said punch mounting nut with the said threaded bore of said ram and wherein said cylindrical portion of said punch mounting nut and said cylindrical, axial bore of said cylindrical ram engage and coact to provide uniform application of engaging force about the periphery of said flange and between said flange and said punch.

6. A bodymaker punch and ram assembly as set forth in claim 5, wherein said threaded portion of said punch mounting nut extends into said ram beyond said first land when said punch mounting nut is in a mating securing engagement with said ram.

* * * * *